US010378280B2

(12) United States Patent
Carter et al.

(10) Patent No.: US 10,378,280 B2
(45) Date of Patent: Aug. 13, 2019

(54) VIBRATIONAL DAMPER WITH REMOVABLE LUGS

(71) Applicant: Utex Industries, Inc., Houston, TX (US)

(72) Inventors: Derek Carter, West Fork, AR (US); Timothy Vincent Burns, Shavertown, PA (US)

(73) Assignee: Utex Industries, Inc., Houston, TX (US)

( * ) Notice: Subject to any disclaimer, the term of this patent is extended or adjusted under 35 U.S.C. 154(b) by 242 days.

(21) Appl. No.: 15/426,231

(22) Filed: Feb. 7, 2017

(65) Prior Publication Data

US 2017/0247946 A1 Aug. 31, 2017

Related U.S. Application Data

(60) Provisional application No. 62/301,251, filed on Feb. 29, 2016.

(51) Int. Cl.
*E21B 3/00* (2006.01)
*E21B 3/04* (2006.01)
*E21B 3/035* (2006.01)

(52) U.S. Cl.
CPC ..... *E21B 3/04* (2013.01); *E21B 3/035* (2013.01)

(58) Field of Classification Search
CPC ..... E21B 3/04; E21B 3/035
See application file for complete search history.

(56) References Cited

U.S. PATENT DOCUMENTS

| | | | | |
|---|---|---|---|---|
| 3,257,827 A | | 6/1966 | Hughes | |
| 3,306,078 A | | 2/1967 | Hughes | |
| 3,779,040 A | | 12/1973 | Garrett | |
| 4,109,488 A | | 8/1978 | Work | |
| 4,575,359 A | * | 3/1986 | Bermingham | E21B 3/02 464/123 |
| 5,372,548 A | | 12/1994 | Wohlfeld | |
| 5,588,916 A | | 12/1996 | Moore | |
| 6,332,841 B1 | | 12/2001 | Secord | |

* cited by examiner

*Primary Examiner* — Brad Harcourt
(74) *Attorney, Agent, or Firm* — Haynes and Boone, LLP

(57) ABSTRACT

Shock absorber systems include a drive plate having a plurality of removable lugs. The drive plate is connectable to a rotary drive shaft. The shock absorber further includes a driven plate connectable to a rotary driven shaft. A housing may be fixedly secured to either or both of the drive plate and the driven plate. The housing may have an outer wall forming a hollow center portion and a plurality of openings extending through the outer wall to the hollow center portion. Each opening of the plurality of openings may have first and second positive stops formed thereon. The shock absorber further comprises an elastomeric member disposed in the housing between the drive plate and the driven plate. The elastomeric member is configured to absorb vibration from the driven plate. Each removable lug of the plurality of removable lugs has first and second striking faces at a radially distal edge and on circumferentially opposing sides.

19 Claims, 6 Drawing Sheets

VIBRATIONAL DAMPER WITH REMOVABLE LUGS

PRIORITY

This application claims the benefit of the filing date of U.S. Provisional Application 62/301,251, filed Feb. 29, 2016, which is incorporated in its entirety herein by reference.

TECHNICAL FIELD

The present description relates, in general to systems and techniques for focusing wear in a vibrational dampener or shock absorber on replaceable components. More specifically, the present disclosure relates to systems and methods including a vibrational dampener or shock absorber for rotary drilling.

BACKGROUND

In various types of drilling operations, the drill bit is forced downward under pressure while being rotated in order to penetrate earthen formations. These drilling operations can require the application of relatively high downward force to the drill bit as well as relatively high torque to turn the drill bit. One example includes a large drilling rig to which is attached a rotary drive mechanism. Typically, the drill's rotary drive is capable of being raised and lowered along a substantially vertical axis directly above the formation to be drilled. Additionally, a length of drill pipe or drill string is connected to the rotary drive so as to extend downwardly therefrom in a substantially vertical direction. A drill bit is secured to the downward end of the drill pipe.

The drilling rig's rotary drive is activated to rotate both the drill pipe and the drill bit at the suitable speed. Then, the rotary drive, together with the drill pipe and drill bit, is lowered so that the drill bit contacts the surface of the formation to be drilled. Downward pressure is then continuously applied to the rotating drill pipe and bit to force the drill bit to cut downwardly into the formation. As the drilling operation occurs, air is forced through the interior of the rotary drive head, drill pipe, and through the drill bit, thereby forcing cuttings out of the hole and maintaining a clear surface upon which the drill bit may operate. When the drilled hole is deep enough to accommodate the first length of drill pipe, the drill's rotary drive is disconnected from the drill pipe and raised to its original position. A second length of drill pipe is then connected between the rotary drive and the first length of drill pipe. The rotary drive is then activated and the drilling operations are continued. This procedure is repeated until a suitable hole depth is achieved.

In order to reduce problems associated with vibration and shock to the drilling apparatus, various devices have been employed to dampen vibrations and absorb torsional forces during the operation of the rotary drill. These devices typically comprise a force absorbing apparatus which is connected between the drill machine's rotary drive head and the drill pipe. In some instances, the force absorbing device includes some type of resilient, or elastomeric, material which absorbs the vibrations and shocks, thereby dissipating the undesirable energy associated with the drilling operation.

Vibration dampeners or shock absorbers have been characterized by short operating lives. Some designs use an elastomeric cushion to absorb the vibrational effects of the drilling process, combined with positive stops that limit deflection of the elastomeric cushion. While effective, these products have a relatively short wear life. As the shock absorbing elastomeric cushion wears, the positive stops are subjected to increased forces. This may wear or damage the shock absorber in any of a number of locations. Damaged shock absorbers require removal from the drill string and replacement, creating work stoppages. In some instances, the shock absorber may be repaired instead of replaced. If the shock absorber is eligible for repair and continued use, it must be serviced. In some instances, this can require a complicated disassembly process.

SUMMARY

It is therefore desirable to have predictable wear on the shock absorber, and to make the shock absorber or components of the shock absorber easy to replace. Use of a softer sacrificial material for the lugs will cause the lugs to wear while preserving the housing when the lugs come into contact with the positive stops of the housing. When the shock absorber is serviced, the lugs and elastomeric element should be easily replaceable while keeping the shock absorber attached to the drive motor and drill string. The ability to know what part of the product will wear and the ability to service the product without removing it from the rig will allow for faster and more efficient repairs.

Some exemplary aspects of the present disclosure are directed to a shock absorber system that includes a drive plate having a plurality of removable lugs. The drive plate may be connectable to a rotary drive shaft. The shock absorber may also include a driven plate connectable to a rotary driven shaft. A housing may be fixedly secured to either of the drive plate and the driven plate. The housing may have an outer wall forming a hollow center portion and a plurality of openings extending through the outer wall to the hollow center portion. Each opening of the plurality of openings may include first and second positive stops formed thereon. An elastomeric member may be disposed in the housing between the drive plate and the driven plate. The elastomeric member is configured to absorb vibration from one of the drive plate and the driven plate. Each removable lug of the plurality of removable lugs may have first and second striking faces at a radially distal edge and on circumferentially opposing sides.

In another exemplary aspect, the present disclosure may be directed to a shock absorber system that includes a drive plate including a plurality of removable lugs and a driven plate that is connectable to a rotary driven shaft. A housing may be fixedly secured to either the drive plate and the driven plate. The housing may have an outer wall forming a hollow center portion, and a plurality of openings extending through the outer wall to the hollow center portion. Each opening of the plurality of openings may have first and second positive stops, and the removable lugs extend at least partially through the openings. The lugs may be configured to selectively engage against opposing sides of the openings in a manner that limits an amount of rotation of the drive plate relative to the driven plate. The removable lugs may be removable and replaceable from the drive plate through the openings. The shock absorber may further include an elastomeric member disposed in the housing between the drive plate and the driven plate. The elastomeric member may be configured to absorb vibration from the drive or driven plates.

In yet another exemplary aspect, the present disclosure is directed to a method of repairing a shock absorber disposed between a drill string and a top drive. The method may include removing a drive plate, which has a removable lug, from an elastomeric element that is disposed in a hollow housing. The hollow housing may have a plurality of openings formed therein, and the removable lug may extend at least partially through one opening of the plurality of openings. The method may also include radially removing the removable lug from the drive plate through the one opening of the plurality of openings. The method may also include radially inserting a replacement lug through the one opening of the plurality of openings. The replacement lug may extend at least partially through the one opening. The method may further include attaching the drive plate to the elastomeric element in the housing.

DETAILED DESCRIPTION

Figure 1:
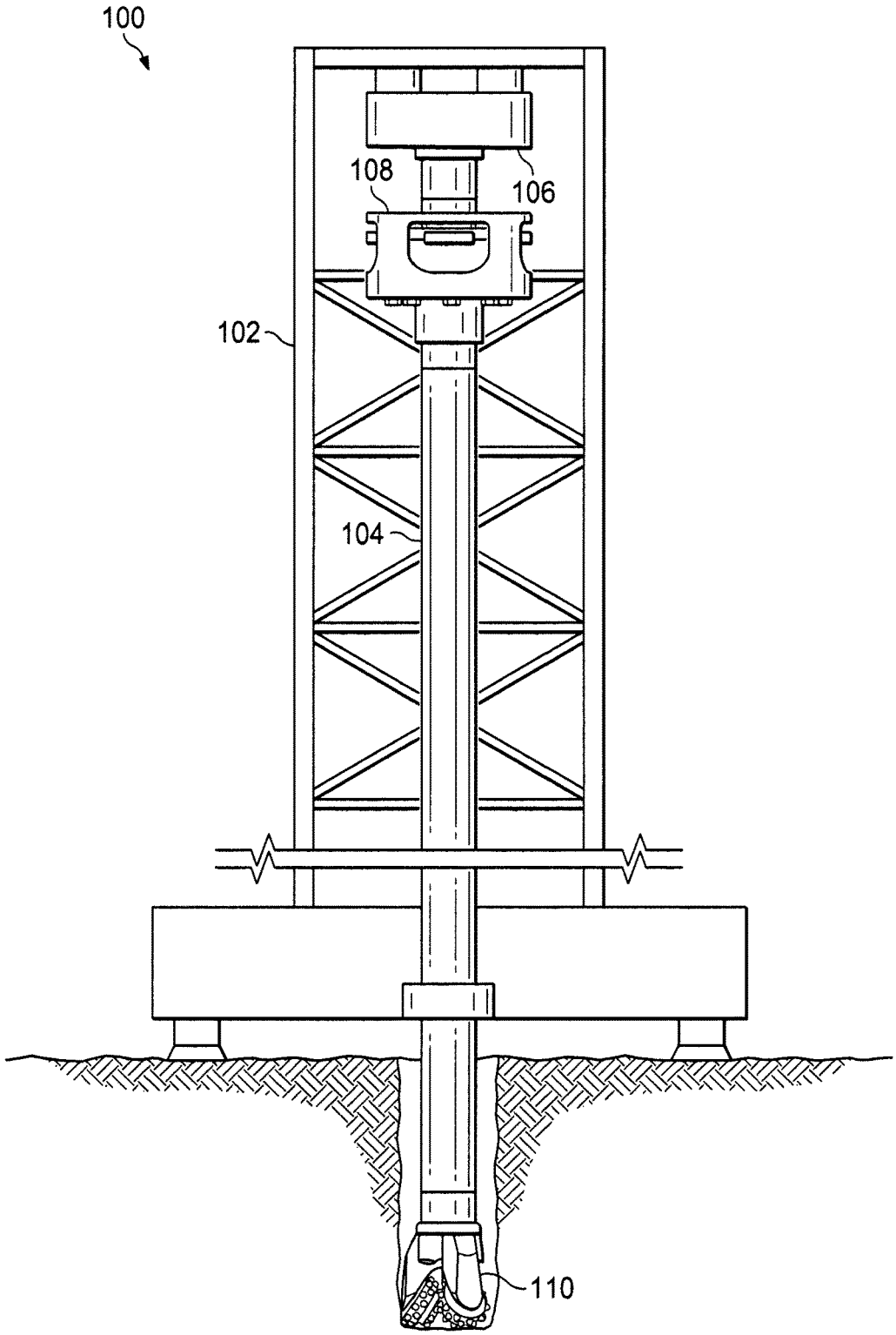
FIG. 1 is a diagram of a drilling rig including a drill string and an exemplary shock absorbing member.

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details.

The present disclosure describes shock absorbing systems and methods for absorbing shock or dampening vibrations in a drill string. Some implementations include removable lugs designed to absorb wear on the shock absorbing system. Because of their design, the lugs may wear faster than other components of the shock absorbing system. In some implementations, these lugs may be removed and replaced, without a need to remove or replace the entire shock absorbing system. In some implementations, the shock absorbing system is used to manage torque on a drive shaft, which may be a rotary drive shaft, of a rotary drilling rig used in well drilling or mining.

Depending on the implementation, the lugs may be accessible through access windows formed in an outer housing that permit a user to replace the lugs in a minimal amount of time. In some implementations, the lugs are sized, shaped, and formed of materials that promote long life, but directed wear. Because of the directed wear, and the accessibility to the replaceable lugs, the shock absorbing system can have a long useful life with minimal rig downtime. This in turn leads to greater drilling efficiencies and increased profitability.

The shock absorbing system can be an important part of a drilling rig because it affords some protection to the expensive driving elements of the rig, such as a top drive. The shock absorbing system may be disposed between and may separate a drive shaft from a driven shaft, which may be a rotary driven shaft. During use, when the drill bit jams or snags, rotation of the driven shaft may slow or stop. The drive shaft may still turn, however, and the slowing of the driven shaft may result in high torque on the drive shaft. Some of this force or torque is absorbed by the shock absorbing system. For example, the shock absorbing system may include an annular body of resilient material that twists or deforms under load, thereby reducing the shock which is communicated to the drive shaft by the driven shaft. When the torque exerted on the annular body of resilient material reaches a predetermined amount, the resilient annular body rotates enough so that the side surfaces, or strike faces, of the lugs contact or engage against a housing that may prevent additional relative rotation of the driven shaft and the drive shaft, thereby avoiding additional torque from being placed on the elastomeric annular body. This prevents the elastomeric member from being exposed to an excessive torque which could potentially damage or weaken it.

In order to prevent the additional relative rotation, the housing may include windows. These windows provide a predetermined limit to the rotational movement as described above, and also provide a predetermined limit to the upward extension of the elastomeric member when the drill string is lifted from a hole. The drill string is lifted by applying lifting force to the drive shaft, which applies lifting force to the drive plate and causes the elastomeric member to stretch. The drive side of the window on the annular housing is above the lug inserts. When the elastomeric member stretches a predetermined amount, the lug inserts on the drive plate contact the drive side of the window, limiting the upward travel of the drive plate and preventing further stretching of the elastomeric member, thereby extending the life of the elastomeric member.

FIG. 1 illustrates an example drilling rig 100 according to an exemplary implementation. In this implementation, the drilling rig 100 includes a derrick 102 which supports a drill string 104.

The drill string 104 is connected to a top drive 106 via a shock absorber 108. The drill string 104 terminates at a drill bit 110. The top drive 106 provides rotary power to the drill bit 110 through the drill string 104. The shock absorber 108 insulates the top drive 106 from at least some of the vibration and shock transmitted through the drill string 104 while the drilling rig 100 is in operation, thereby reducing wear on the top drive 106.

Figure 2A:
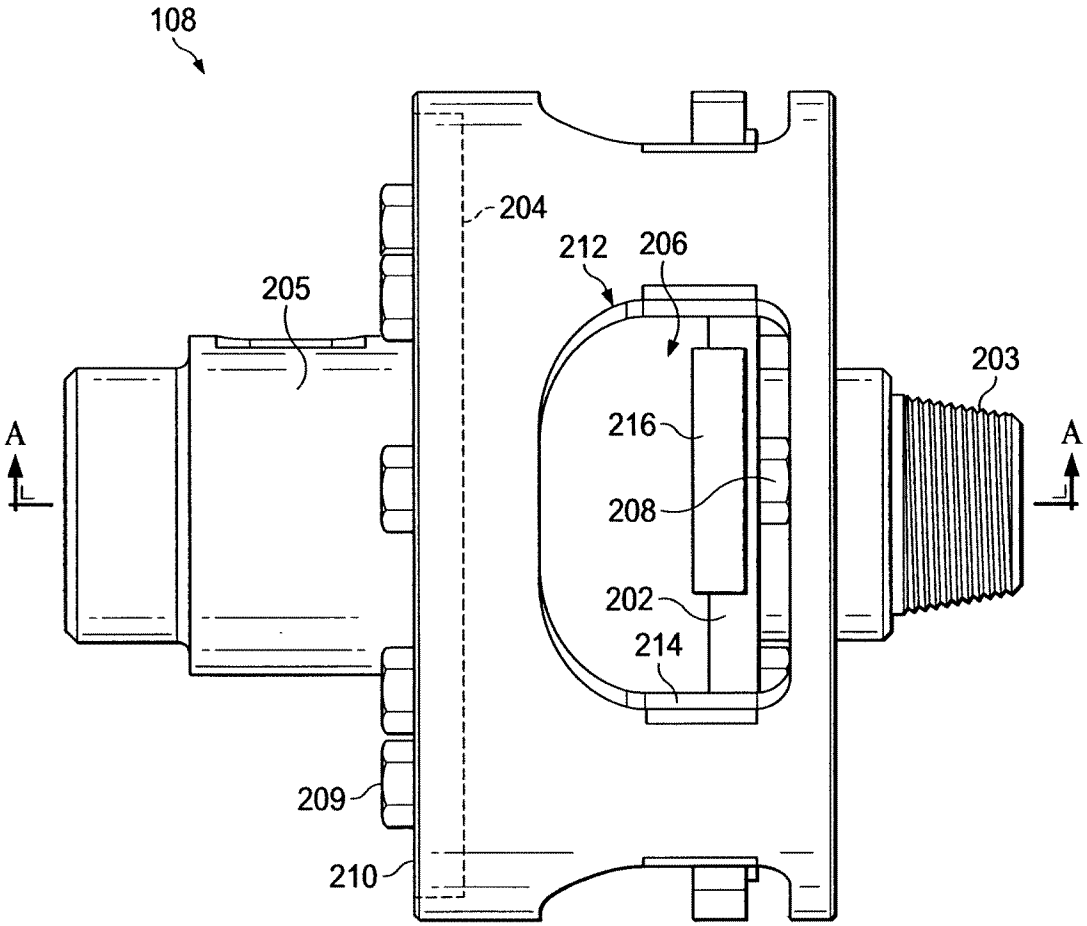
FIG. 2A is a side view of a shock absorbing member.
Figure 2B:
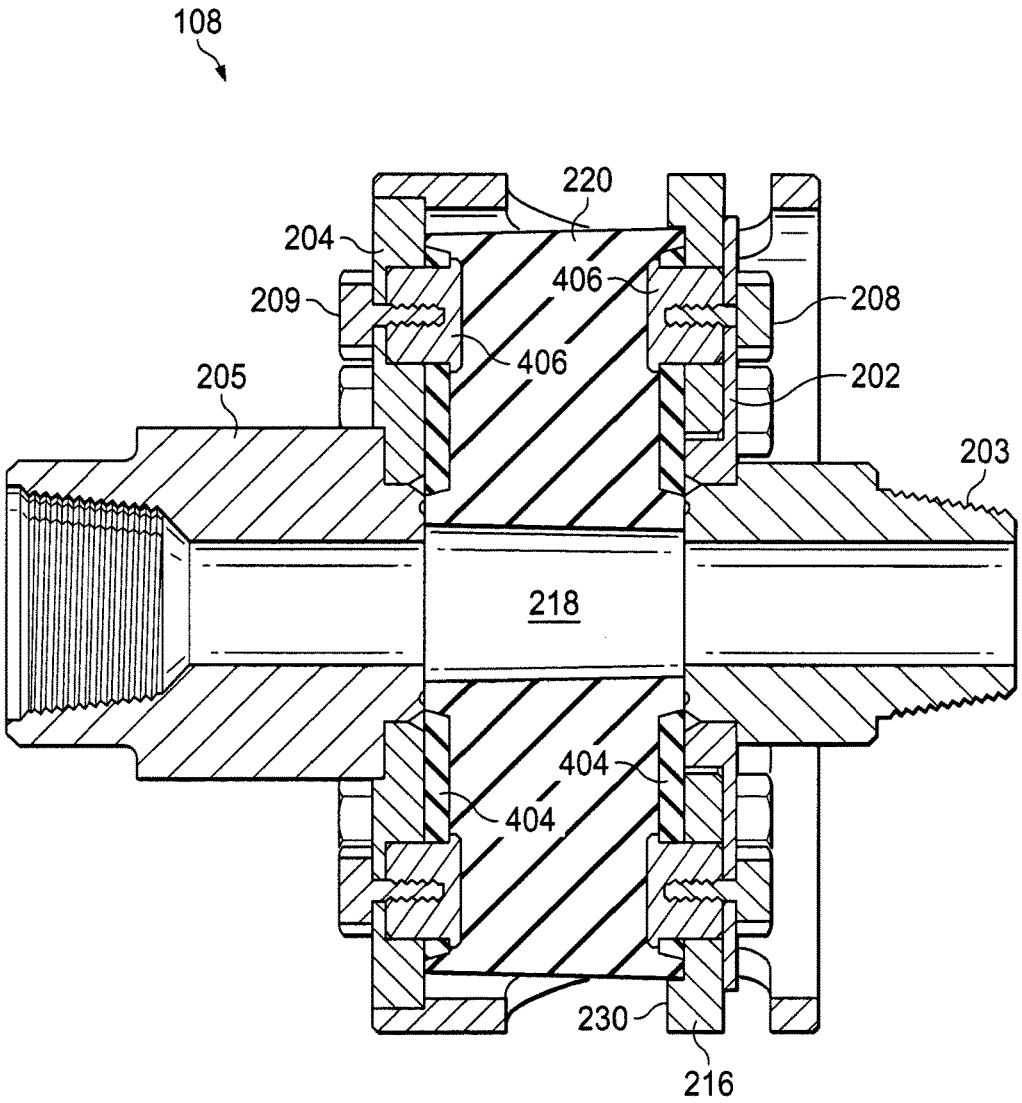
FIG. 2B is an axial cross section view of the shock absorbing member of FIG. 2A.

The drilling rig 100 in the example shown is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure. FIGS. 2A and 2B illustrate an exemplary implementation of the shock absorber 108. FIG. 2A illustrates a side view of the shock absorber 108, and FIG. 2B illustrates a cross section of shock absorber 108 along line A-A of FIG. 2A. The shock absorber 108 may include a drive plate 202, a driven plate 204, an elastomeric element 206, fasteners 208 and 209, and a housing 210. In some implementations, the drive plate 202 may be substantially disc shaped and may include a coupling interface 203 arranged and configured to couple to the top drive 106 (FIG. 1). In some implementations, the coupling interface 203 may be a threaded coupling. FIGS. 2A and 2B show a male end of a coupling interface having threads on its externally facing surface. In other implementations, the coupling interface 203 may be a bolt coupling, a welded coupling, or any other appropriate coupling that enables the drive plate 202 to connect securely with the top drive 106. The drive plate 202 receives driving force from the top drive 106 once it is coupled via coupling interface 203. In the example shown, the drive plate 202 and the coupling interface 203 are fixed to one another via a weld or other permanent fixture. In some implementations, the drive plate 202 and the coupling interface 203 are formed or cast as a monolithic component.

The driven plate 204, visible in phantom in FIG. 2A and fully visible in FIG. 2B, is shown as disc shaped. The driven plate 204 however, may have any suitable shape enabling the shock absorber 108 to properly function. In the implementation shown, the driven plate 204 has a coupling interface 205 for coupling to the drill string 104 or an intermediate drilling component. The coupling interface 205 may be similar to coupling interface 203 in some respects. For example, each may include threads for directly attaching to respective drilling components. In the exemplary embodiment shown, the coupling interface 205 may include internal threads that interface with threads of drill string components or other components that connect the shock absorber 108 to the drill string 104 (FIG. 1). In other implementations, the coupling interfaces 203 and 205 may be welded to, adhered to, or otherwise connected to respective drilling components as would be contemplated by one of ordinary skill in the art.

The elastomeric element 206 may be a cylindrical component configured to absorb and dampen vibration and shock in order to protect components of the drilling rig 100. In this implementation, the elastomeric element 206 includes a main body portion 220 and elastomeric element plates 404 disposed at each end of the main body portion 220.

In some implementations, the main body portion 220 and the elastomeric element plates 404 may be formed of any elastomeric material, including rubber or other polymeric materials. In other implementations, the main body portion 220 is formed of an elastomeric material, and the elastomeric element plates 404 may be formed of a non-elastomeric material. In some implementations, the elastomeric element plates 404 may be formed of a rigid material, such as a metal material, that may be embedded within the elastomeric element 206. It is worth noting that the elastomeric element plates 404 may be rigidly adhered to the main body portion 220 such that torsional loads applied to the elastomeric element plates 404 may be dampened by the main body portion 220.

The elastomeric element plates 404 may include bosses 406 that may facilitate attachment of the main body portion 220 to the drive plate 202 and to the driven plate 204. For example, the bosses 406 may extend from the elastomeric element plates 404 at opposing ends of the main body portion 220. In some embodiments, the bosses 406 may be arranged to receive bolts or other fasteners that connect the elastomeric element 206 to the drive plate 202 and the driven plate 204. As can be seen in the cross-sectional view in FIG. 2B, both ends of the elastomeric element 206 include the elastomeric element plate 404 with its bosses 406.

As best seen in FIG. 2B, the drive plate 202 may be coupled to one end of the elastomeric element 206, and the driven plate 204 may be coupled to the opposing end of elastomeric element 206, allowing force to be transferred from the drive plate 202 to the driven plate 204 through the elastomeric element 206. In the case that drive plate 202 and driven plate 204 are disc shaped, elastomeric element 206 may be cylindrical and/or annular so that the drive plate 202, driven plate 204, and elastomeric element 206 have a cylindrical profile when coupled together. Fasteners 208 and 209 are used to secure the drive plate 202 and the driven plate 204, respectively, to the elastomeric element 206, allowing easy separation of the drive plate 202 and driven plate 204 from the elastomeric element 206 for maintenance or replacement. In some embodiments, fasteners 208 and 209 may be bolts or other appropriate removable fasteners.

Figure 4:
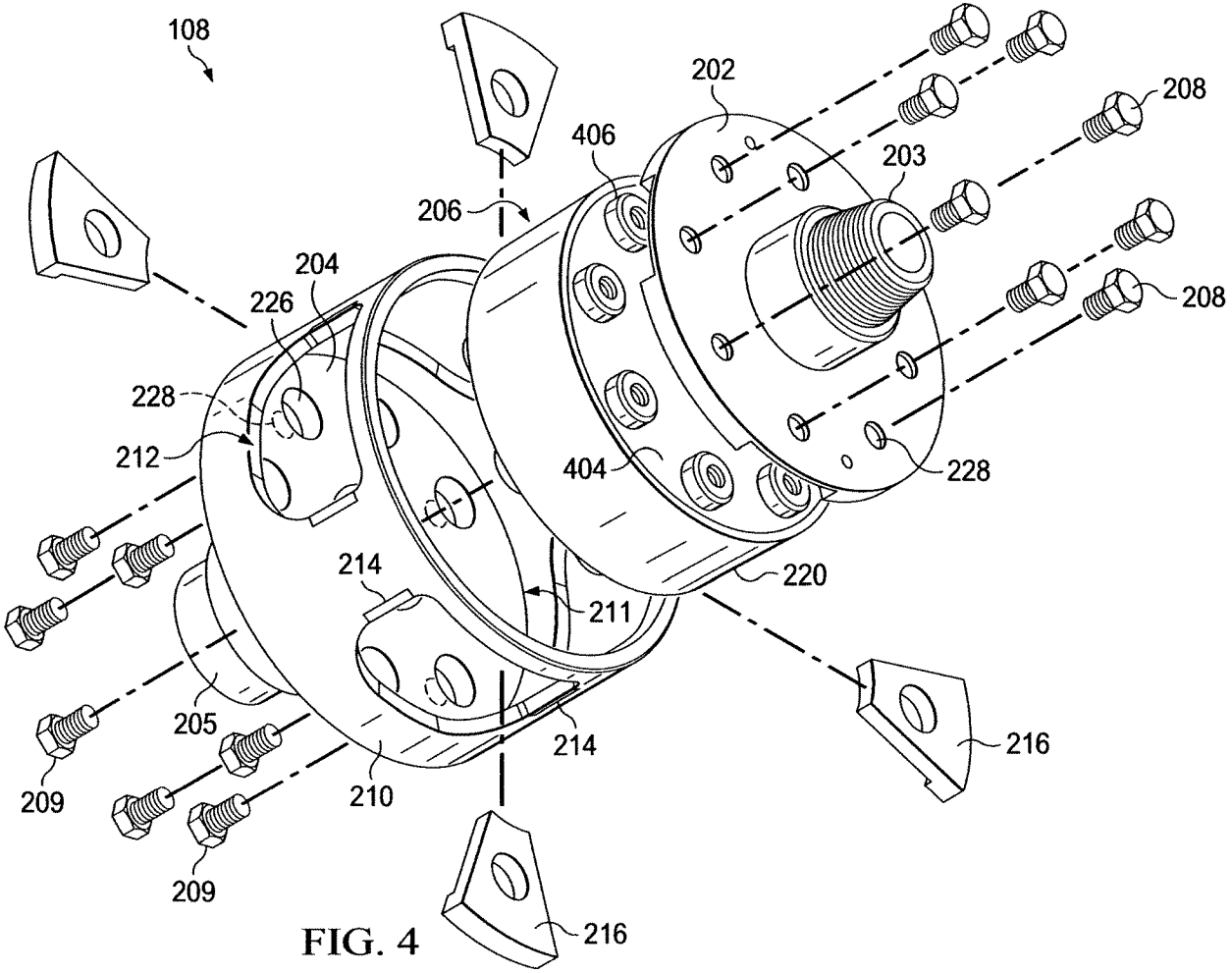
FIG. 4 is an exploded view of the shock absorbing member of FIG. 2A.

In this implementation, the drive plate 202, the driven plate 204, and the elastomeric element 206 may be connected together to form a subassembly. In implementations where the drive plate 202 and driven plate 204 are disc shaped, the housing 210 may be cylindrical and hollow so that it is adapted to receive and enclose the drive plate 202, the driven plate 204 and the elastomeric element 206. In some embodiments, the housing 210 may be fixedly secured at one end to driven plate 204, for example via welds. In other embodiments, the housing 210 and the driven plate 204 may be formed of a monolithic material. Housing 210 may extend away from driven plate 204 to enclose elastomeric element 206 and drive plate 202 in its hollow center portion 211. Housing 210 may have spaced windows or openings 212 through its outer walls that expose at least some portions of drive plate 202. At least a portion of the sides of windows 212 may serve as positive stops 214 (FIG. 4). In the implementation shown, the positive stops 214 are formed on sides of windows 212 that run insubstantially in a longitudinal direction relative to the direction of the drill string and the shock absorber 108. As such, these positive stops may act to limit rotational movement of the elastomeric element 206 in a manner described herein. In some implementations, the positive stops may be composed of a harder material than the rest of housing 210. In some implementations, the positive stops 214 may be formed by embedding extra hard and shatter resistant material in the sides of the windows 212. In some implementations, the positive stops 214 may be formed by applying a hard facing material to the edge of the windows 212. In some examples, this may include filling recesses in housing 210 at the edge of windows 212 with the hardfacing material. Although described herein as "windows", some implementations employ other openings that are shaped as slots or otherwise shape with edges that may not form enclosed boundaries. For example, some implementations employ U-shaped slots in place of windows, with the positive stops being disposed on the longitudinally-extending edges of the slots.

In the exemplary embodiment shown, the drive plate 202, the driven plate 204, and the elastomeric element 206, all include a centrally disposed passage 218 that enables fluid such as compressed air to pass from the top drive through the shock absorber 108, and into the drill string.

Figure 3:
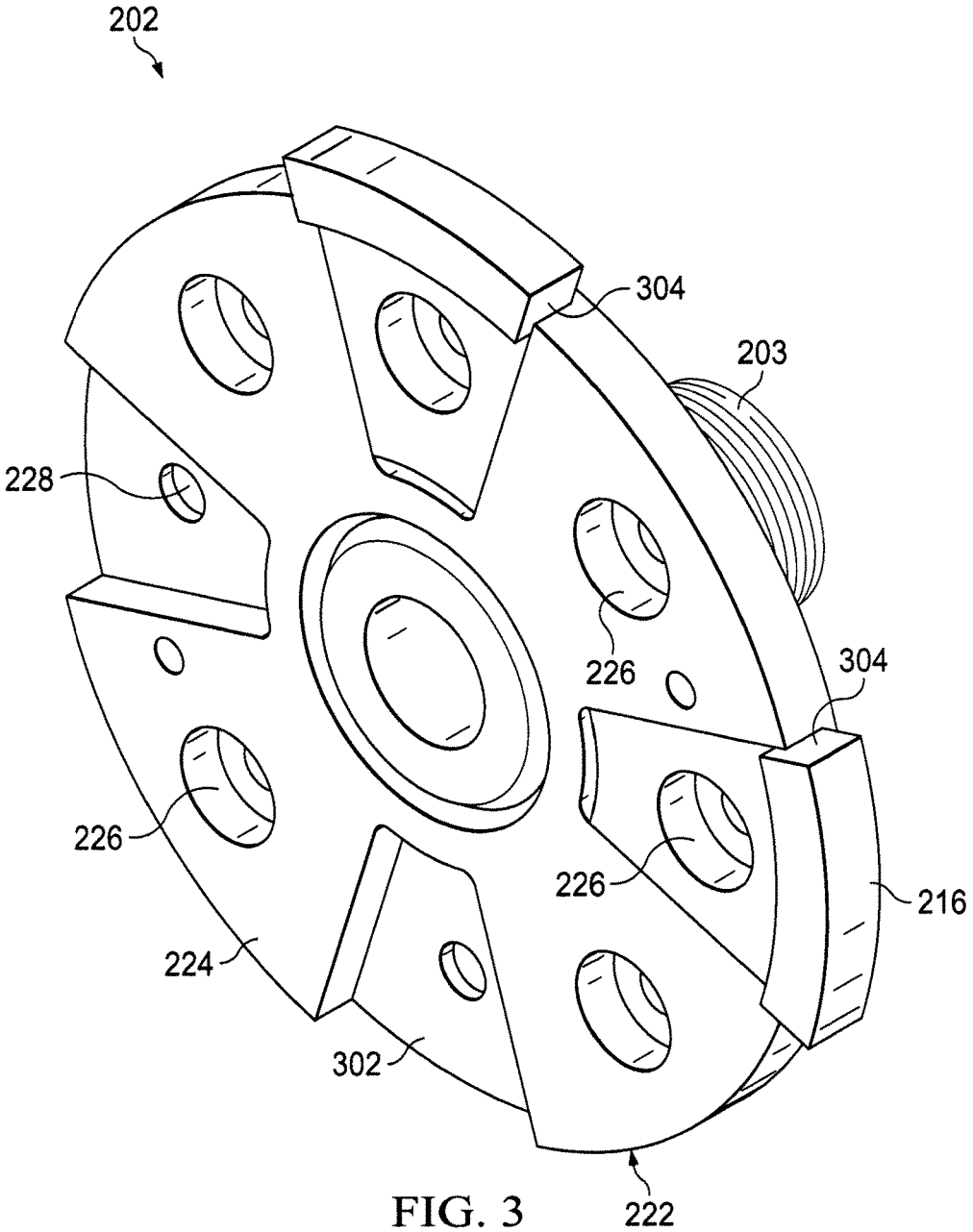
FIG. 3 is a perspective view of a drive plate of the shock absorbing member of FIG. 2A containing removable lugs.

FIG. 3 illustrates a perspective view of the drive plate 202. As shown in FIG. 3, the drive plate 202 includes the coupling interface 203 and a circular plate body 222. The circular plate body 222 includes a planar surface 224, a plurality of pockets 302 formed in the planar surface 224, and a plurality of removable lugs 216 disposed in the plurality of pockets 302. The planar surface 224 may be disposed to face the elastomeric element 206. In some implementations, the planar surface 224 may abut against the surface of the elastomeric element 206. The plurality of pockets 302 are formed as recesses or depressions in the planar surface 224. In the implementation shown, each pocket 302 extends radially inward from a periphery of the drive plate 202. In the implementation shown, the pocket 302 terminates prior to reaching a center of the drive plate 202. Accordingly, each pocket 302 may be generally triangular-frustum shaped. In this implementation, the drive plate 202 includes four pockets 302 equally spaced along the edge of the planar surface 224. For ease of understanding, the drive plate 202 in FIG. 3 shows removable lugs 216 disposed within two of the pockets 302, and shows two of the pockets 302 without the removable lugs 216. It should be understood that removable lugs 216 may be disposed in each of the pockets 302.

The removable lugs 216 may be generally triangular or sector shaped and may be formed to fit generally within the pockets 302. However, the removable lugs 216 may have a radial length greater than a radial length of the pockets 302, such that when seated into pockets 302, the removable lugs 216 may extend radially beyond the edge of drive plate 202. Each of the removable lugs 216 may include striking faces 304 that interface with edges of the windows of the housing 210 in a manner described further below. The exposed strike faces 304 form the sides of the radially distal edge of the removable lugs 216. In the implementation shown, the removable lugs 216 also include a radial lip 230 formed at its most-radial end. As can be best seen in FIG. 2B, the radial lip 230 may be configured to extend over an edge of the elastomeric element 206. In addition, the radial lip 230 may provide additional surface area and material that may act as a positive stop against over rotation.

The circular plate body 222 includes a series of openings 226 that, in the exemplary implementation shown, enable the drive plate 202 to connect with and be rotationally secured to the elastomeric element 206. Referring to FIG. 2B, the bosses 406 may extend into the openings 226. As can be seen in FIG. 3, the openings 226 are formed in the planar surface 224 and in the removable lugs 216. In this implementation, the openings 226 are disposed at 45° angles. Because the openings 226 receive the bosses 406, the drive plate 202 may be rotationally secured via mechanical interference with the elastomeric element 206.

The circular plate body 222 further includes a second series of openings 228 that, in the exemplary implementation shown, enable the drive plate 202 to be fastened to the elastomeric element 206 via fasteners 208. As described above, bosses 406 may be arranged to receive bolts or other appropriate fasteners 208. Openings 228 are sized to allow fasteners 208 to pass through the drive plate 202 into openings 226, which receive bosses 406, such that the fasteners 208 can be fastened into bosses 406, securing the drive plate 202 to the elastomeric element 206, as further described below. In the exemplary embodiment, openings 228 are smaller in diameter than openings 226 so that a portion of drive plate 202 is sandwiched between fasteners 208 and bosses 406 when fasteners 208.

Referring again to FIG. 2A, when the drive plate 202 is secured to the elastomeric element 206 within housing 210, the removable lugs 216 are secured in place against the drive plate 202 by fasteners 208. Furthermore, the radially distal edges of removable lugs 216 extend into windows 212 of housing 210 such that when the drive plate 202 rotates in either direction, the strike faces 304 will come into contact with positive stops 214, retarding the rotation of the removable lugs 216, which in turn retard the rotation of drive plate 202. As noted above, drive plate 202 and removable lugs 216 will rotate within housing 210 as elastomeric element 206 deflects. Accordingly, the width of windows 212 relative to the arc length of the radially distal edge of removable lugs 216 may be calibrated to stop deflection of elastomeric element 206 after a predetermined amount of rotation. For example, in some implementations the radial width of the windows 212 may fall within a range of 45° to 75°. The radial width of the removable lugs 216 may fall within a range of about 30° to 40°. Accordingly, the windows 212 may stop deflection of the elastomeric element 206 when the removable lugs 216 strike the edge of the windows 212. These values are intended to be example values only, and other values, both smaller and larger, may be used to achieve suitable dampening.

Additionally, when an axial lifting force is applied to the coupling interface 203, elastomeric element 206 may stretch in an axial direction and removable lugs 216 may come into contact with the drive side edge of windows 212, thus transferring the lifting force to the housing 210 and limiting the maximum stretching distance of elastomeric element 206. In the implementation shown, there may be an equal number of removable lugs 216 and windows 212 so that one lug fits into each window 212.

FIG. 4 illustrates an exploded view of the shock absorber 108. As described herein, the elastomeric element 206 is composed of a main body portion 220, for example a rubber component, and may have the elastomeric element plates 404 bonded or otherwise attached to the top and bottom sides of the main body portion 220 as described herein. The elastomeric element plates 404 each have a set of bosses 406 formed on them. The drive plate 202 with the removable lugs 216 and the driven plate 204 may be adapted to fit over bosses 406. Bosses 406 may be adapted to receive fasteners 208 and 209. For example, if fasteners 208 and 209 are bolts, bosses 406 may have internal threading to receive the fasteners 208 and 209. As described herein, drive plate 202, removable lugs 216, and driven plate 204 may additionally have openings 226 adapted to receive the bosses 406, the recesses having openings 228 therethrough. This may allow for easy orientation of bosses 406 with the holes in the drive plate 202 and driven plate 204 through which fasteners 208 and 209 are inserted to secure the drive plate 202 and driven plate 204 to the elastomeric element 206. In some implementations, the bosses 406 may be rigidly connected with the elastomeric element plates 404. For example, the bosses 406 may be connected via a weld or other rigid connection. In some implementations, the bosses 406 and the elastomeric element plates 404 are machined or cast as solid monolithic elements.

In implementations where the housing 210 and the driven plate 204 are fixed together, assembling the shock absorber 108 may be done by inserting the elastomeric element 206 into the housing 210 so that bosses 406 on the bottom elastomeric element plate 404 fit into recesses on driven plate 204. Fasteners 209 may be used to secure the driven plate 204 to the elastomeric element 206. Removable lugs 216 may each be inserted through a window 212 and fit over a boss 406 on the top elastomeric element plate 404. The drive plate 202 may then be inserted into the housing 210 and fit over the removable lugs 216 and the elastomeric element 206. Fasteners 208 may then be used to secure the drive plate 202 to the elastomeric element 206, sandwiching the removable lugs 216 into place within pockets 302 of drive plate 202, and between the drive plate 202 and the elastomeric element 206.

In some embodiments, the removable lugs 216 may be formed of a sacrificial material that is softer than a material used to form positive stops 214 on housing 210. This is advantageous as it focuses wear on the removable lugs 216 while ensuring that housing 210 remains unworn or less worn by contact between positive stops 214 and removable lugs 216. Furthermore, knowledge of the properties of the sacrificial material of the removable lugs 216 and the material of the housing 210 may allow a user of the drilling rig 100 to know the useful life of the removable lugs 216.

Once removable lugs 216 have reached the end of their useful life due to repeated contact with positive stops 214, fasteners 208 may be removed, freeing drive plate 202 from elastomeric element 206. Drive plate 202 may be lifted away from elastomeric element 206, which frees removable lugs 216 to be lifted off of bosses 406 and removed through windows 212 of housing 210. If the elastomeric element 206 has reached the end of its useful life, fasteners 209 may be removed, freeing elastomeric element 206 from driven plate 204, and elastomeric element 206 may be lifted out of housing 210 and replaced with a new elastomeric element 206. The new elastomeric element 206 may be refastened to driven plate 204 with fasteners 209. A new set of removable lugs 216 may be inserted through windows 212 and placed over bosses 406, and drive plate 202 may be replaced in the housing and secured back to the elastomeric element 206. Accordingly, the removable lugs 216 may be replaced without requiring removal of the coupling interface 203 from the power elements of the drilling rig 100. This may greatly increase the efficiency of maintaining the shock absorber 108 over conventional systems.

Figure 5:
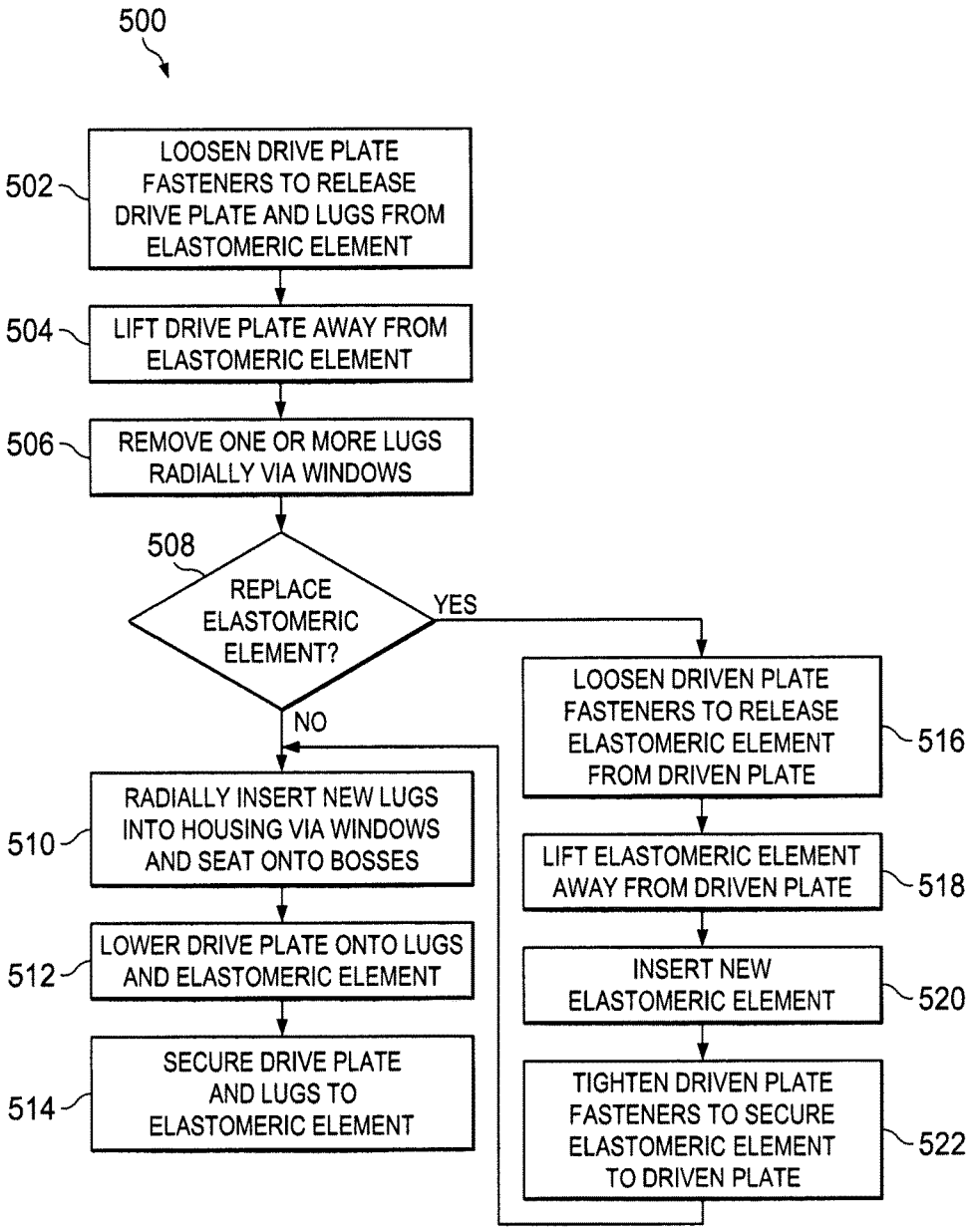
FIG. 5 is a flowchart of a method for replacing components of the shock absorbing member of FIG. 2A.

FIG. 5 is a flow diagram of a method 500 of repairing a shock absorber 108, and specifically replacing removable lugs 216 and the elastomeric element 206. Beginning at block 502, fasteners 208 are loosened such that drive plate 202 is no longer secured to elastomeric element 206. At block 504, drive plate 202 may be lifted in an axial direction away from elastomeric element 206. At block 506, one or more of removable lugs 216 may be accessed via the windows 212 and removed from the shock absorber 108 by lifting them in an axial direction off of bosses 406. They may then be removed radially from the shock absorber 108 via windows 212. At decision block 508, if the elastomeric element 206 does not need to be replaced, the method may move to block 510, and new removable lugs 216 may be radially inserted into housing 210 via windows 212 and seated onto bosses 406. At block 512, drive plate 202 may be axially lowered over removable lugs 216 and elastomeric element 206. At block 514, fasteners 208 may be tightened to secure drive plate 202 to elastomeric element 206.

If at decision block 508, the elastomeric element 206 needs to be replaced, the method may move from decision block 508 to block 516, and fasteners 209 may be loosened such that driven plate 204 is no longer secured to elastomeric element 206. At block 518, elastomeric element 206 may be lifted in an axial direction away from driven plate 204 and out of housing 210. At block 520, a new elastomeric element 206 may be axially inserted into housing 210 and seated against driven plate 204. At block 522, fasteners 209 may be tightened to secure elastomeric element 206 to driven plate 204. The method may then return to block 510. In the case that the removable lugs 216 have not reached the end of their useful life, old removable lugs 216 may be used in block 510 rather than new removable lugs 216.

Although the disclosure describes the replaceable lugs as being disposed on the drive plate and describes the housing on the driven plate, some implementations include the replaceable lugs on the driven plate and include the housing on the drive plate. In some implementations, the replaceable lugs are removed via an opening in the housing in an axial direction instead of a radial direction.

Various embodiments of the present disclosure may include advantages over prior solutions. In conventional rotational shock absorbers, when the lugs on a drive plate have reached the end of their useful life, the entire drive plate must be removed from the shock absorber, which requires removal of the entire housing from the drill string. Additionally, if the lugs are not made out of a sacrificial material, significant wear may occur on the housing itself, requiring replacement of the entire housing and driven plate, which also necessitates removal of the housing from the drill string. By contrast, various embodiments herein allow replacement of worn lugs without removal of the drive plate or the housing from the drill string. Furthermore, use of sacrificial materials for the removable lugs focuses wear on the easily replaceable removable lugs, increasing the life of the housing significantly and reducing uncertainty with respect to what in the shock absorber needs replacement.

As those of some skill in this art will by now appreciate and depending on the particular application at hand, many modifications, substitutions and variations can be made in and to the materials, apparatus, configurations and methods of use of the devices of the present disclosure without departing from the spirit and scope thereof. In light of this, the scope of the present disclosure should not be limited to that of the particular embodiments illustrated and described herein, as they are merely by way of some examples thereof, but rather, should be fully commensurate with that of the claims appended hereafter and their functional equivalents.

What is claimed is:

1. A shock absorber connectable between a rotary drive shaft and a rotary driven shaft, comprising:

a first plate including a plurality of removable lugs;

a second plate;

a housing fixedly secured to the second plate, the housing having an outer wall forming a hollow center portion and a plurality of openings extending through the outer wall to the hollow center portion, each opening of the plurality of openings having first and second positive stops formed thereon; and an elastomeric member disposed in the housing between the first plate and the second plate, the elastomeric member being configured to absorb vibration from the second plate, wherein each removable lug of the plurality of removable lugs has first and second striking faces at a radially distal edge and on circumferentially opposing sides, wherein the first and second positive stops are composed of a first material, each of the plurality of removable lugs is composed of a second material, and the second material is softer than the first material.

2. The shock absorber of claim 1, wherein:

the first plate further includes a plurality of pockets formed therein, and the plurality of removable lugs is adapted to fit within the plurality of pockets.

3. The shock absorber of claim 1, wherein each of the plurality of removable lugs is substantially triangularly shaped.

4. The shock absorber of claim 1, further comprising:

a first set of fasteners and a second set of fasteners, wherein the first plate comprises a first set of openings formed therethrough, the second plate comprises a second set of openings formed therethrough, the elastomeric member comprises a first plurality of bosses formed on a first side and a second plurality of bosses formed on a second side, each of the plurality of removable lugs has an opening formed therethrough, the first plurality of bosses are insertable into the first set of openings of the first plate and the openings of the plurality of removable lugs to secure the plurality of removable lugs between the first side of the elastomeric member and the first plate, the second plurality of bosses are insertable into the second set of openings of the second plate to secure the second plate to the second side of the elastomeric member, the first set of fasteners is insertable through the first set of openings in the first plate, through the openings in the plurality of removable lugs, and into the first plurality of bosses to fasten them together, and the second set of fasteners is insertable through the second set of openings in the second plate and into the second plurality of bosses to fasten them together.

5. The shock absorber of claim 4, wherein the elastomeric member is a rubber member and comprises:

a first metal plate fixedly connected to the first side of the elastomeric member, the first metal plate comprising the first plurality of bosses; and a second metal plate fixed to the second side of the elastomeric member, the second metal plate comprising the second plurality of bosses.

6. The shock absorber of claim 1, wherein each of the plurality of removable lugs are positioned relative to the openings of the housing so that the first striking face of each of the plurality of removable lugs contacts the first positive stop of a respective one of the openings when a torque is applied to the rotary drive shaft in a first direction, and so that the second striking face of each of the plurality of removable lugs contacts the second positive stop of the respective one of the openings when a torque is applied to the rotary drive shaft in a second opposite direction.

7. The shock absorber of claim 1, wherein the plurality of removable lugs are radially removable and radially insertable through the plurality of openings of the housing.

8. The shock absorber of claim 1, wherein the removable lugs each comprise a radial lip formed at a most-radial end, the radial lip comprising the first and second striking faces.

9. A shock absorber connectable between a rotary drive shaft and a rotary driven shaft comprising:

a first plate including a plurality of removable lugs;

a second plate;

a housing fixedly secured to the second plate, the housing having an outer wall forming a hollow center portion and a plurality of openings extending through the outer wall to the hollow center portion, each opening of the plurality of openings having first and second positive stops, the removable lugs extending at least partially through the openings and configured to selectively engage against opposing sides of the openings in a manner that limits an amount of rotation of the first plate relative to the second plate, the removable lugs being removable and replaceable from the first plate through the openings; and an elastomeric member disposed in the housing between the first plate and the second plate, the elastomeric member being configured to absorb vibration from the second plate wherein the first and second positive stops are composed of a first material and the plurality of removable lugs is composed of a second material softer than the first material.

10. The shock absorber of claim 9, wherein the first plate is connected to a drive shaft of a drilling rig and the second plate is connectable to a rotary driven shaft.

11. The shock absorber of claim 9, wherein the second plate is connected to a drive shaft of a drilling rig and the first plate is connectable to a rotary driven shaft.

12. The shock absorber of claim 9, wherein:

the first plate further includes a plurality of pockets formed therein, and the plurality of removable lugs is adapted to fit within the plurality of pockets.

13. The shock absorber of claim 9, wherein each of the plurality of removable lugs is generally triangularly shaped.

14. The shock absorber of claim 9, wherein the plurality of removable lugs are radially removable and radially insertable through the plurality of openings of the housing.

15. The shock absorber of claim 9, wherein the removable lugs each comprise a radial lip formed at a most-radial end, the radial lip comprising first and second striking faces.

16. A method of repairing a shock absorber disposed between a drill string and a top drive comprising:

removing a first plate having a removable lug from an elastomeric element disposed in a hollow housing having a plurality of openings formed therein, the removable lug extending at least partially through one opening of the plurality of openings;

removing the removable lug from the first plate through the one opening of the plurality of openings;

inserting a replacement lug through the one opening of the plurality of openings, the replacement lug extending at least partially through the one opening; and attaching the first plate to the elastomeric element in the housing to secure the replacement lug in place extending partially through the one opening.

17. The method of claim 16, comprising loosening a second plate to release the elastomeric element from the second plate and removing the elastomeric element from the hollow housing.

18. The method of claim 16, wherein removing the removable lug comprises lifting the removable lug from a recess formed in a planar surface of the first plate.

19. The method of claim 16, comprising inserting a boss on the elastomeric element through an opening of the removable lug to maintain the lug in place on the first plate.

* * * * *